US008056897B2

(12) United States Patent
deJong et al.

(10) Patent No.: US 8,056,897 B2
(45) Date of Patent: Nov. 15, 2011

(54) MOVING SENSOR FOR SHEET EDGE POSITION MEASUREMENT

(75) Inventors: Joannes N. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 53 days.

(21) Appl. No.: 11/729,467

(22) Filed: Mar. 29, 2007

(65) Prior Publication Data

US 2008/0240820 A1 Oct. 2, 2008

(51) Int. Cl.
*B65H 7/02* (2006.01)

(52) U.S. Cl. ..... 271/227; 271/228; 271/265.01

(58) Field of Classification Search ..... 271/227, 271/228, 258.01, 265.01
See application file for complete search history.

(56) References Cited

U.S. PATENT DOCUMENTS

| | | | | |
|---|---|---|---|---|
| 4,971,304 | A | 11/1990 | Lofthus | 271/227 |
| 5,112,038 | A * | 5/1992 | Dunaway | 271/10.03 |
| 5,169,140 | A | 12/1992 | Wenthe, Jr. | 271/228 |
| 5,219,159 | A * | 6/1993 | Malachowski et al. | 271/228 |
| 5,278,624 | A | 1/1994 | Kamprath et al. | 355/317 |
| 5,322,273 | A | 6/1994 | Rapkin et al. | 271/227 |
| 5,678,159 | A | 10/1997 | Williams et al. | 399/395 |
| 5,697,608 | A | 12/1997 | Castelli et al. | 271/228 |
| 5,715,514 | A | 2/1998 | Williams et al. | 399/395 |
| 5,794,176 | A | 8/1998 | Milillo | 702/150 |
| 5,848,344 | A | 12/1998 | Milillo et al. | 399/395 |
| 5,994,711 | A | 11/1999 | Seachman et al. | 250/559.36 |
| 6,059,285 | A * | 5/2000 | Suga et al. | 271/228 |
| 6,137,989 | A | 10/2000 | Quesnel | 399/394 |
| 6,168,153 | B1 | 1/2001 | Richards et al. | 271/227 |
| 6,173,952 | B1 | 1/2001 | Richards et al. | 271/228 |
| 6,181,153 | B1 | 1/2001 | Mahanpour | 324/765 |
| 6,318,714 | B1 * | 11/2001 | Beskitt et al. | 271/10.01 |
| 6,373,042 | B1 | 4/2002 | Kretschmann et al. | 250/208.1 |
| 6,511,239 | B1 | 1/2003 | Kretschmann et al. | 400/579 |
| 6,533,268 | B2 | 3/2003 | Williams et al. | 271/228 |
| 6,585,262 | B2 * | 7/2003 | Nakanishi | 271/270 |
| 6,836,627 | B2 | 12/2004 | Kretschmann et al. | 399/82 |
| 6,866,260 | B2 | 3/2005 | Williams et al. | 271/227 |
| 6,978,992 | B2 * | 12/2005 | Otsuka | 271/10.01 |
| 6,988,725 | B2 | 1/2006 | Rapkin | 271/227 |
| 2004/0223022 | A1 * | 11/2004 | Endo | 347/19 |
| 2006/0033795 | A1 * | 2/2006 | Yokoi | 347/104 |
| 2006/0163801 | A1 * | 7/2006 | Dejong et al. | 271/227 |

FOREIGN PATENT DOCUMENTS

JP 05116811 A * 5/1993

* cited by examiner

*Primary Examiner* — Stefano Karmis
*Assistant Examiner* — Ernesto Suarez
(74) *Attorney, Agent, or Firm* — Alix, Yale & Ristas, LLP

(57) ABSTRACT

A method and apparatus for determining the lateral position of a moving sheet in a sheet registration system. A side edge sensor is moved from a known location until the side edge of the moving sheet is detected. A signal is generated indicative of the position of the side edge when it is detected. The position of the side edge as indicated by the signal is used along with skew of the sheet to determine the lateral position of the sheet.

9 Claims, 5 Drawing Sheets

MOVING SENSOR FOR SHEET EDGE POSITION MEASUREMENT

TECHNICAL FIELD

The present disclosure relates generally to office equipment such as printers, copiers and the like, and more particularly, to a method and apparatus for determining the position of the side edge of a sheet being fed.

BACKGROUND

Office equipment such as printers and copiers, which place images based on digital data onto sheets, such as sheets of paper are well known. In such equipment it is important that the sheet that is to receive the image is properly aligned with the edge of the feed path as well as not skewed so that the image is properly positioned on the sheet. Various types of registration systems to correct for skew and provide for positioning of the side edge of the sheet are know in the art.

One type of lateral registration system involves the use of two differentially driven nips for deskewing and side registration. Such a system can provide lateral registration of the sheet by deskewing (differentially driving the two nips to remove any sensed initial sheet skew) and then deliberately inducing a fixed amount of sheet skew (rotation) with further differential driving, and driving the sheet forward while so skewed, thereby feeding the sheet sideways as well as forwardly, and then removing that induced skew after providing the desired amount of sheet side-shift providing the desired lateral registration position of the sheet edge.

Another type of system is a translating electronic registration (TELER) system. Such a system generally includes three optical sensors, a pair of coaxial independently driven drive rolls, a carriage with a linear drive on which paper drive rolls are mounted, and a microprocessor controller. A copy sheet is driven into the nip rolls and moved through the paper path for placement and transferring of an image thereon. The speed of both nip rolls can be controlled to effect skew alignment and longitudinal registration. The nip rollers are mounted on a carriage movable transversely with respect to the feed path. A sensor system controls positioning of the carriage to achieve the desired top edge or a lateral positioning of the sheet. Independent control of nip roll drive and carriage translation provides simultaneous alignment in lateral and longitudinal directions.

Examples of these systems may be found in U.S. Pat. No. 4,971,304 to Lofthus; U.S. Pat. No. 5,169,140 to Wenthe, Jr.; U.S. Pat. No. 5,219,159 to Malahowski et al; U.S. Pat. No. 5,278,624 to Kamprath et al; U.S. Pat. No. 5,794,176 to Milillo; U.S. Pat. No. 6,137,989 to Quesnel; U.S. Pat. No. 6,181,153 to Richards et al; U.S. Pat. No. 6,533,268 to Williams et al; U.S. Pat. No. 6,866,260; and U.S. Pat. No. 6,988,725 to Rapkin. The disclosure of each of these patents is incorporated herein by reference in its entirety.

In many of the sheet registration systems, measurement of the lateral (cross process) sheet edge position is required before taking corrective action. For center-registration systems, sheets of varying width (in the cross process direction) require a sensor measurement range of about 60-70 mm for commonly used sheet widths. Previously used sensors such as CCDs become expensive especially when a long array is required. Analog sensors lack the required accuracy.

Other patents showing lateral edge sensors include U.S. Pat. No. 6,373,042 to Kretschmann et al; U.S. Pat. No. 6,511,239 to Kretschmann et al; and U.S. Pat. No. 6,836,627 to Kretschmann et al. The disclosure of each of these patents is incorporated herein by reference in its entirety.

At the present time a moving lateral sensor system is used in a TELER type registration system. A reflective point sensor is attached to a timing belt which is driven by a stepping motor. In the operation, a sensor is positioned in the nominal location before the sheet reaches the registration nips of the registration device which are mounted down stream of the sensor. The nominal sensor location is one-half of the nominal sheet width from the center-line of the paper path. Upon entry of the sheet into the registration device, the lateral registration controller moves the sheet until the lateral sensor detects the sheet edge.

There is a need for an improved type of lateral sensor. In TELER registration devices, the registration controller must move the sheet into positron to be sensed by the sensor in a short period of time. Velocities and accelerations are by necessity large. A sensor as described above is not applicable for use in the two nip differentially driven deskewing system as describe above since in such systems, the position of the sheet must be measured before the registration device starts the registration correction move.

SUMMARY

According to one aspect of the present disclosure there is provided a method for determining the position of a moving sheet in a registration system comprising moving a sensor from a known location until the side edge of the sheet is detected. A signal is generated which is indicative of the position of the side edge when sensed by the sensor. The skew of the sheet is determined by sensing the lead edge of said sheet by sensors and the signal indicative of the side edge position and the skew of the sheet is used in determining the lateral position of the sheet.

According to another aspect of the present disclosure there is provided a method of determining the side edge of a moving sheet in a registration system having an X direction in which the sheet is moving and a Y direction perpendicular to the X direction comprising moving the sheet along a path in the X direction and moving a side edge sensor in the Y direction from a known Y position until the side edge is detected. The Y position of the sensor is noted when said side edge is detected. A signal is sent to a controller indicative of the Y position of the sensor when the side edge is detected.

According to a further aspect of the present disclosure, there is provided a system for determining the side edge of a moving sheet in a registration system comprising a path for moving the sheet in the X direction. A side edge sensor is moveable in the Y direction from a known Y position until the side edge of a sheet is detected, and a controller is provided for causing said side edge sensor to move in the Y direction until it senses the side edge of a sheet, the side edge sensor sends a signal back to the controller indicative of the position of the side edge of the sheet for use in the registration of said sheet.

DETAILED DESCRIPTION

Figure 1:
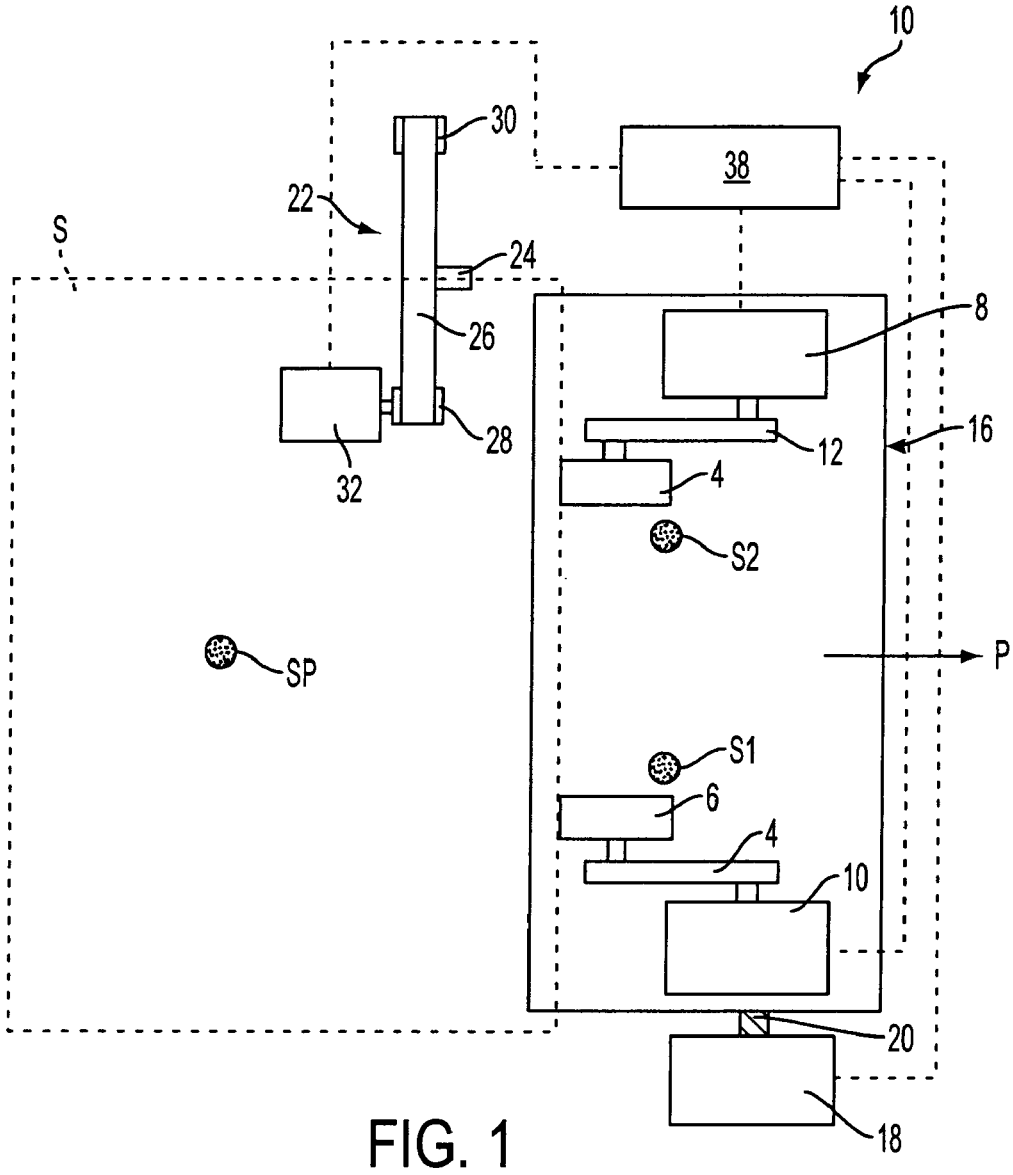
FIG. 1 is a schematic plan view of a registration system using the lateral edge sensor described herein.

Referring to the drawings, and particularly FIG. 1, a schematic representation of a registration system 10 with which the embodiment of the sensor described herein may be used is shown. The system 10 includes two spaced drive rolls 4 and 6 which are adapted to mate with idler rolls (not shown) positioned above a respective drive roll 4, 6 and which together form a nip for frictional engagement of a sheet "S". The drive rolls 4 and 6 are shown driven by independent drivable motors 8 and 10. The drive motors 8 and 10 are preferably speed controllable stepping motors, although other types of speed controllable servo motors may be used. The rotary output of each motor 8 and 10 is transmitted to its respective drive roll 4 and 6 by suitable power transmission means such as belts 12 and 14. The drive rolls 4 and 6 and their respective drive motors 8 and 10, as well as the idler rolls, may be mounted on a carriage 16 which is moveable in a direction perpendicular to the path P of the sheet. The carriage 16 is moved by a drive system which includes a speed controllable stepping motor 18, or other similar speed controllable servo motor. The output shaft of the motor 18 drives a lead screw 20 which is connected to an internally threaded drive block (not shown) on the carriage 12.

Although the foregoing description has mentioned two independently drivable motors 8 and 10 for the drive rolls 4 and 6, it is possible to provide a system capable of skew control with the use of a single speed controllable drive roller used in conjunction with a drive roll driven at a constant speed. For example, the drive roll 4 could be driven through a suitable drive transmission, such as a belt or gear train from the main motor of the office machine itself, at a constant speed. Skew correction could be achieved by varying the speed of the second drive roll 6 with respect to the constant velocity drive roll.

Still with reference to FIG. 1, a moveable side edge sensor 22 is positioned upstream of the drive rolls 4 and 6 and includes, generally, a sensor head 24 mounted on a timing belt 26. The timing belt 26 is mounted between a drive pulley 28 and an idler pulley 30. The drive pulley 28 is driven by a stepping motor 32 or other appropriate timing servo motor. The sensor head 24 includes an appropriate sensor such as a reflective point sensor with opposing mirror which senses the presence or absence of a sheet S and in turn detects the side edge SE of the sheet S. As used herein, the term "side edge" or alternatively "lateral edge", refers to the edge of the sheet S which runs parallel to path P of travel of the sheet S even if the particular image placed on the sheet causes the "side edge" of the fed sheet to be the top or bottom edge of the fed sheet relative to the image printed thereon. The "top side edge" as used herein refers to the side edge that is detected by the side edge sensor 22.

Figure 2:
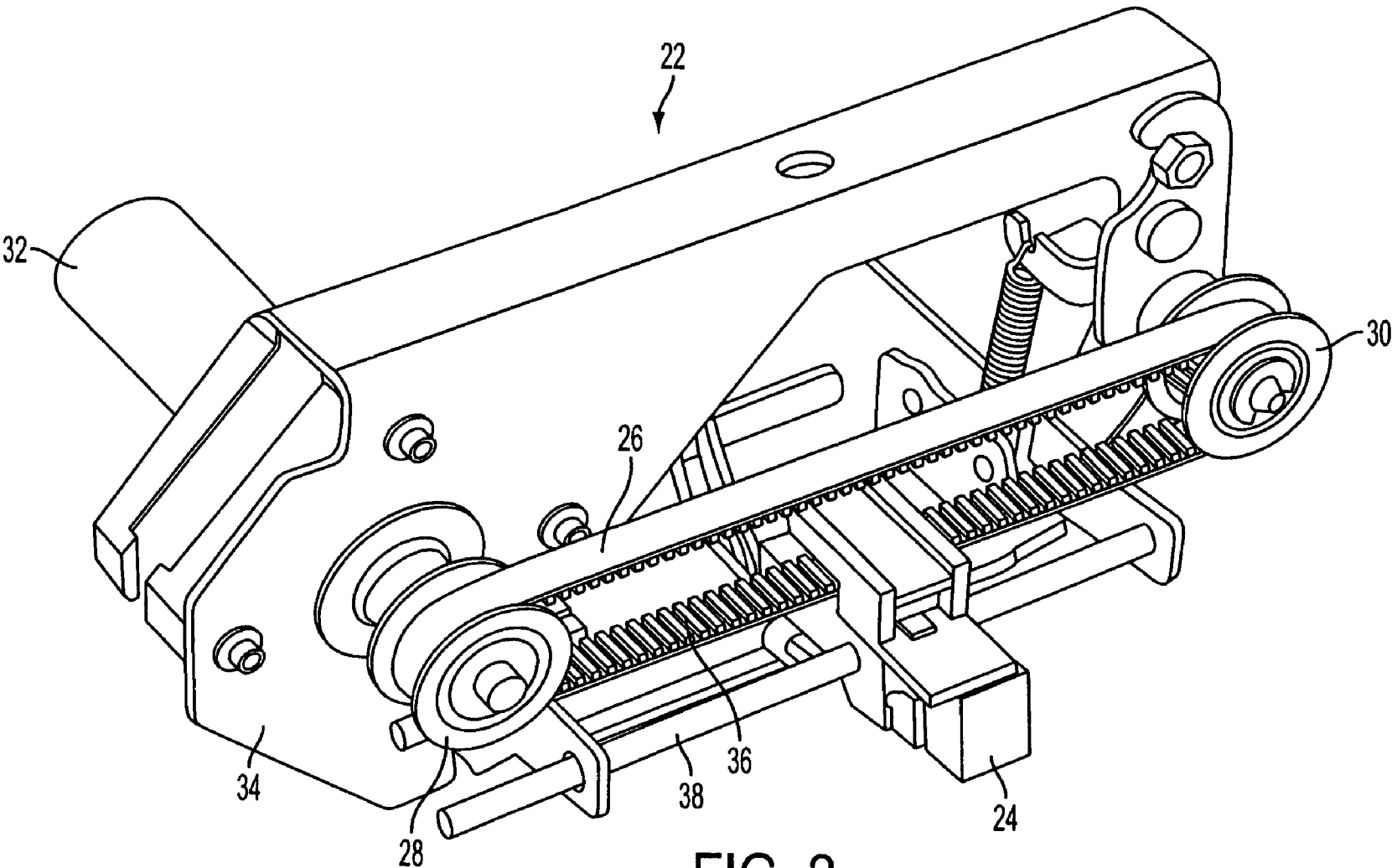
FIG. 2 is a schematic isometric view of an embodiment of the moveable lateral edge sensor.

The side edge sensor 22 is constructed so that the sensor head 24 is movable in a direction perpendicular to the path P of the sheet S and has a range of travel so that it can move to the side edge SE of a sheet S regardless of the size of the sheet being transported and also with any possible offset of the sheet with respect to the centerline of the path. Referring to FIG. 2, the sensor 22 includes a bracket 34 fixed to the machine and designed to provide a mounting for the two spaced pulleys 28 and 30. The timing belt 26 extends between the two pulleys 28 and 30 as shown. The stepping motor 32 is mounted on the bracket 34 and has its drive shaft (not shown) connected to one of the pulleys 28 to provide a drive for the timing belt 26. The sensor head 24 housing a sensor is mounted is attached to the bottom run 36 of the timing belt 26 and is moveable therewith. The sensor head 24 is mounted on a guide rod 38 that is attached to the bracket 34 extends perpendicular to the path P of the sheet S. In the embodiment shown, the sensor light is reflected off a mirror which is below the paper path. When the sheet edge is detected, the beam of light is broken, thus providing an edge detection signal. Other sheet edge sensing system may or may not need to use a reflective mirror.

Figure 3:
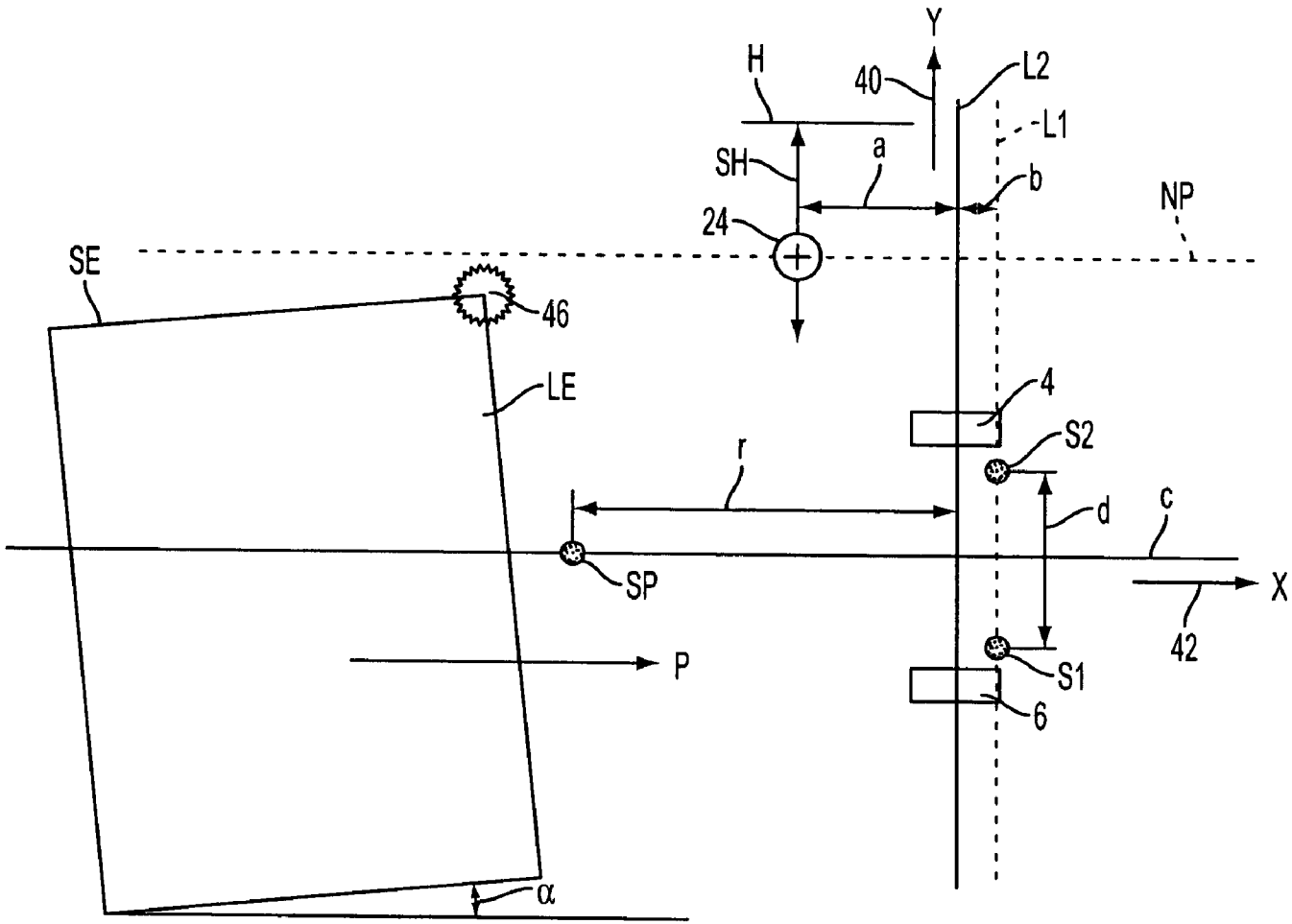
FIG. 3 is a schematic plan view of a sheet as it is transported along the path of a registration device using the embodiment of the sensor described herein and showing the relationship of the various sensors.

Two spaced sensors S1 and S2 are provided for sensing the leading edge LE of the sheet S. As shown in FIG. 3, the sensors S1 and S2 are spaced apart a fixed distance d on a line L1 that is substantially perpendicular to the path of travel of the sheet S along path P. Additionally, sensors S1 and S2 are positioned slightly downstream from the drive rolls 4 and 6 and each such sensor S1, S2 is usually, but not necessarily, spaced equidistant from a sheet path centerline C. A point sensor SP is positioned along the sheet path usually, but not necessarily, on the centerline C a fixed distance r upstream from the drive rolls 4 and 6. The side edge sensor head 24 with its included sensor is positioned upstream from a line L2 that is perpendicular to the path P of the sheet S a distance a as shown. Preferably the line L2 is in a vertical plane passing through the nips formed by the drive rolls 4 and 6 and their respective idler rolls. Line L1 on which the sensors S1 and S2 are positioned is spaced downstream of line L2 a distance "b". The sensors SP, S1, S2 and 22 all communicate with a controller 38 which performs the necessary calculations and sends appropriate signals to actuate the various servo motors 8, 10, 18 and 32.

Referring to FIG. 3, in operation, the sheet S is traveling at a nominal velocity V in the direction along the path P of the sheet S as indicated by the arrow. The sheet S may have a side edge SE skewed at an angle $\alpha$ with respect to a line parallel to the centerline as shown. The sheet S may also be laterally offset from the nominal position indicated by the dashed line NP. This is the position to which the particular sized sheet needs to be reregistered. In the case shown in FIG. 3, the sheet is offset in a negative direction along the Y axis from the nominal position NP, although it is to be understood that in some cases the sheet may be offset in a positive direction from the nominal position NP. As indicated in the Figures, the positive Y direction is the direction indicated by the arrow 40. Similarly, the positive X direction is the direction indicated by the arrow 42.

Figure 4:
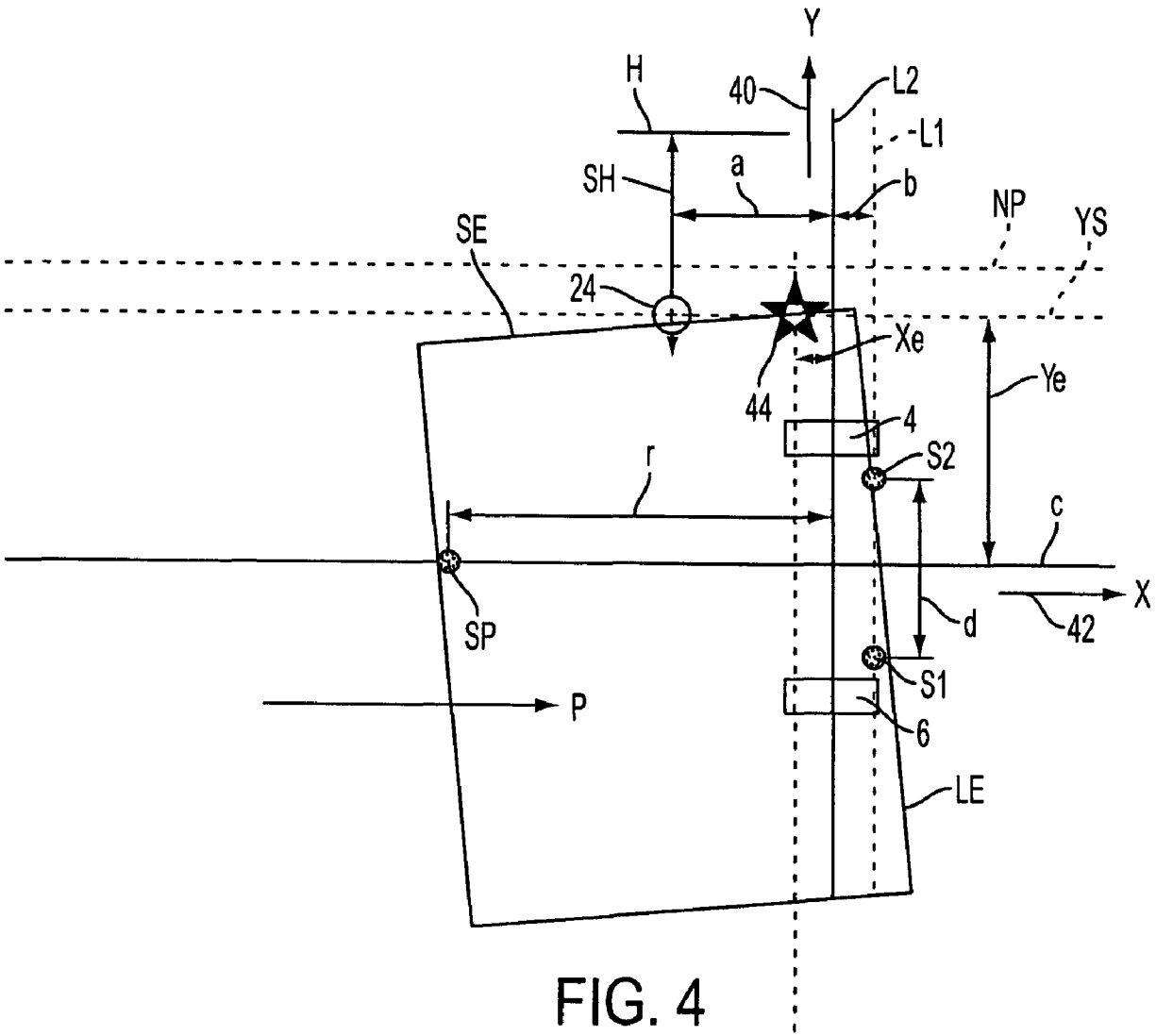
FIG. 4 is a schematic view similar to FIG. 2, but showing the sheet in a position further downstream of the position of FIG. 3.

When the leading edge LE of the sheet S passes the sensor SP, the clock associated with the side edge sensor 24, is set to t=0. Before the leading edge LE of the sheet S reaches a line X=−a (the line SH of movement of the sensor head 24 as shown in FIGS. 3 and 4), the sensor head 24 is moved to a known starting distance from its home position H. The preferred location for this starting distance is the nominal position NP for the particular sheet size being fed. Although this location is preferred, it is not necessary for proper functioning and a starting distance anywhere in the Y direction is possible. The constraining factor is the amount of distance the sensor head 24 has to move and the amount of time available. The starting position is denoted as Ystart.

When the sheet has reached a position where its leading edge LE is past the sensor head 24 in the X direction, (where the position is greater than −a plus a short distance to account for the angle due to any skewing) the movement of the sensor head 24 in the Y direction is started. The time it takes for the leading edge to reach this position at which the movement of the sensor head 24 is started can be calculated from the velocity V of the sheet and the distance from point P to the point −a (less a short distance to account for skew). If the sensor head 24 senses that it is covering the sheet S, the movement is in the positive Y-direction. If the sensor head 24 does not sense the sheet, the movement of the sensor head 24 is in the negative Y-direction.

The sensor head 24 will continued to move until, at some point in time, designated Te, the sensor crosses the side edge SE of the sheet S the edge of the sheet. This Y-location Ye of the sensor head 24 indicated by the dashed line YS is saved by the controller. This sensor position Ye can be calculated by counting the steps of the stepping motor, or can be measured by an additional sensor. At this point the system waits until the sheet passes sensors S1 and S2 into the position shown in FIG. 4. The time that the leading edge LE of the sheet S passes sensors S1 and S2 is noted by the controller as tS1 and tS2.

The distance the sheet traveled after the sensor head 24 has sensed the side edge SE of the sheet S until the leading edge LE is detected by the sensor S2 is calculated from the following:

$$(tS2-Te)*V$$

where,

V=velocity of the sheet in the direction parallel to the path P of travel;

tS2 is the time the sheet S was sensed by the sensor S2; and

Te is the time the side edge SE was sensed by the sensor head 24.

The X-coordinate Xe of the point on the side edge SE that was detected by the sensor head 24 (denoted by the star 44 in FIG. 4) is calculated by the controller using the following:

$$Xe=a-(tS2-Te)*V$$

where, a=the X position of the sensor head 24, i.e., the distance along the X axis from the longitudinal axis of the rolls 4 and 6 at X=0 to the side sensor 24; and (tS2−Te)*V=is as calculated above.

The sheet angle α, or angle of skew, can be calculated from:

$$=\tan^{-1}V*(tS1-tS2)/d$$

or for small angles $$=V*(tS1-tS2)/d$$

where,

V=velocity of the sheet in the direction parallel to the path P of travel;

tS1=the time the sheet was sensed by the sensor S1;

tS2=the time the sheet was sensed by the sensor S2; and d=the distance between the two sensors S1 and S2.

From the above, the position of the corner of top side edge and leading edge of the sheet S (the top right corner of the sheet as indicated by the serrated circle 46 in FIG. 3) is the intersection of the lines defined by the following two equations:

$$Y=\tan\alpha*(x-Xe)+Ye$$

and $$Y=\tan(\mathrm{pi}/2+\alpha)*(x-b)+d/2$$

where,

Xe=the X coordinate of the point on the side edge of the sheet that is sensed by the side sensor;

Ye=the Y coordinate of the spot on the side edge of the sheet that is sensed by the side sensor;

b=the distance in the X-direction from the from the longitudinal axis of the rolls to the sensor S2; and d=the distance between the sensors S1 and S2.

The solving of the two above equations for the variable y provides the Y position of the upper front edge of the sheet as shown in FIG. 4. This value may then be used to calculate the distance and direction the sheet must be moved so that the top front edge of the sheet is properly positioned in the Y-direction. Normally this is at the nominal position as explained above. An appropriate signal is sent to the lateral registration device to accomplish the move. After the Y-position has been calculated as described above, the deskewing operation is started.

Figure 5:
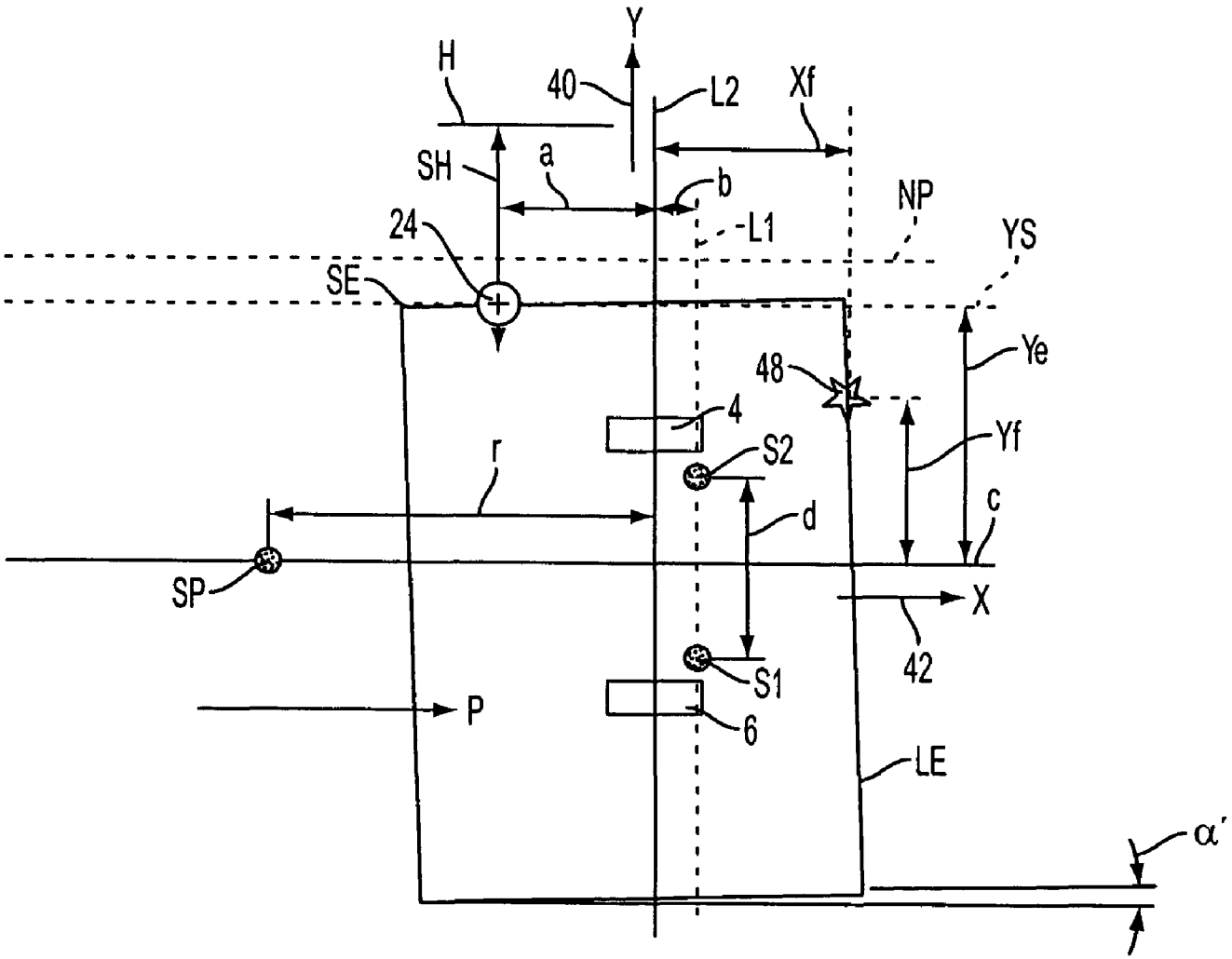
FIG. 5 is a schematic view showing the sheet positioned for calculation of the side edge position under different conditions from those shown in FIGS. 3 and 4.

FIG. 5 shows a second aspect of the use of the moveable side sensor 24. This Figure shows the condition when the sensor detects the edge after the sheet has passes the sensors S1 and S2. In such a case, the registration controller may have moved the sheet S in the lateral (Y) direction, rotated the sheet and changed its velocity. When the sensor head 24 detects the side edge SE of the sheet S at the position indicated by the dashed line YS, the Y position of the side edge at that point is noted as Ye. The controller 38 keeps track of the point on the leading edge LE of the sheet S that was detected by the sensor S2, denoted by the star 48 in FIG. 5, and the coordinates Xf, Yf of that point at the time of detection of the side edge SE by the sensor head 24. Also the registration controller calculates the angle α' of the side edge to the axis of the path at the point in time of the detection of the side edge. With this information, at the instant the side edge SE is detected by the sensor head 24, the coordinates x, y of the right top corner of the sheet S as viewed in FIG. 5 can be calculated by the controller from the intersection of the two lines defined by the following equations:

$$y=\tan\alpha'*(x+a)+Ye$$

and $$y=\tan(\mathrm{pi}/2+\alpha')*(x-Xf)+Yf$$

where,

Ye=the Y coordinate of the spot on the side edge of the sheet that is sensed by the side sensor;

Xf=the X coordinate of the point on the leading edge of the sheet that is detected by sensor S2;

Yf=the Y coordinate of the point on the leading edge of the sheet that is detected by sensor S2; and a=the distance in the X direction from the longitudinal axis of the rolls to the side sensor.

The solution of these two equations for the variable y gives the Y coordinate of the upper edge of the sheet S. This value can be is used by the controller to determine the distance the edge is required to be move to bring it into registration with the desired position which, as explained above, is preferably the nominal position.

The above described embodiments have application in various types of office equipment including, but not limited to, electrostatographic machines.

It will be appreciated that various of the above-disclosed and other features and functions, or alternative thereof, may be desirably combined into many other different systems or application. Various presently unforeseen or unanticipated alternatives, modifications, variation, or improvements therein may be subsequently made by those skilled in the art which are also intended to be encompassed by the following claims.

The invention claimed is:

1. A method of moving a sheet to a desired Y position during movement of the sheet through a registration system having an X direction in which the sheet is moving and a Y direction perpendicular to the X direction, comprising;

moving the sheet along a path in the X direction, moving a side edge sensor in the Y direction from a known Y position during passage of the sheet through the registration system until the top side edge is detected, noting the Y position of the sensor when said side edge is detected, detecting the leading edge of said sheet by a plurality of leading edge sensors positioned on the same Y axis, sending a signal to a controller indicative of the Y position of the sensor when the top side edge is detected, sending a signal to the controller indicative of the time when the leading edge passes each of the leading edge sensors, using the signals sent to the controller from the leading edge sensors and side edge sensor to determine the skew of said sheet and the Y coordinate of the corner of the top side edge and leading edge of said sheet, and using the Y coordinate of the corner of the to side edge and leading edge to provide information to said registration system for moving the sheet to the desired Y position.

2. The method of claim 1 wherein the known Y position of said side edge sensor is the Y position to which the sheet is to be moved.

3. The method of claim 1 wherein said side edge sensor is initially located in a home position in the Y direction, and said sensor is moved to said known Y position before the leading edge of said sheet reaches the X position of the sensor.

4. The method of claim 1 wherein the side edge sensor moves in a direction away from the centerline of the sheet toward the top side edge of the sheet if it initially detects a sheet until it detects the absence of a sheet, and moves in the opposite direction toward the center line of said sheet if it initially detects the absence of a sheet until it detects the presence of a sheet.

5. The method of claim 1 wherein the leading edge sensors are positioned a fixed distance downstream of the X position of said side edge sensor.

6. The method of claim 1 wherein said sheet passes said leading edge sensors before said side edge sensor detects said side edge.

7. The method of claim 1 wherein said side edge sensor detects said side edge prior to said sheet passing said leading edge sensors.

8. The method of claim 1 wherein the time is set to zero when the sheet is sensed by a point sensor upstream of said side edge sensor and the time the side edge is detected is noted, and further including noting the time when the leading edge passes each of said leading edge sensors, calculating the distance the sheet traveled after the side edge was detected up until the leading edge was detected by the second of the leading edge sensors, calculating the angle of skew and the X coordinate of the location of the point on the side edge that was detected by the side edge sensor when the leading edge is sensed by the second sensor, and calculating the Y coordinate of the corner of the top side edge and leading edge of said sheet.

9. The method of claim 1 further including detecting the leading edge of said sheet by a plurality of leading edge sensors positioned on the same Y axis before detecting said side edge, keeping track of the location of the point on the leading edge that was detected by the second of said leading edge sensors and noting the X and Y coordinates of that point and the angle of skew, and calculating the Y coordinate of the corner of the top side edge and leading edge.

* * * * *